US010232645B2

(12) United States Patent
Yato

(10) Patent No.: US 10,232,645 B2
(45) Date of Patent: Mar. 19, 2019

(54) MEDIUM TRANSPORTATION DEVICE AND RECORDING APPARATUS

(71) Applicant: SEIKO EPSON CORPORATION, Tokyo (JP)

(72) Inventor: Keiichi Yato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/685,927

(22) Filed: Aug. 24, 2017

(65) Prior Publication Data

US 2018/0056674 A1 Mar. 1, 2018

(30) Foreign Application Priority Data

Sep. 1, 2016 (JP) ..... 2016-171054

(51) Int. Cl.

| | |
|---|---|
| ***B41J 11/00*** | (2006.01) |
| ***B41J 29/13*** | (2006.01) |
| ***B41J 13/00*** | (2006.01) |
| ***B41J 29/17*** | (2006.01) |
| ***B41J 15/04*** | (2006.01) |
| ***B41J 29/02*** | (2006.01) |

(52) U.S. Cl.

CPC ..... *B41J 11/0095* (2013.01); *B41J 11/0055* (2013.01); *B41J 13/0036* (2013.01); *B41J 15/046* (2013.01); *B41J 29/02* (2013.01); *B41J 29/13* (2013.01); *B41J 29/17* (2013.01)

(58) Field of Classification Search

CPC ..... B41J 11/0095; B41J 13/0036; B41J 29/13

See application file for complete search history.

(56) References Cited

U.S. PATENT DOCUMENTS

2014/0092192 A1* 4/2014 Yajima ..... B41J 29/17 347/104

FOREIGN PATENT DOCUMENTS

| | | | |
|---|---|---|---|
| JP | 2005-263395 | A | 9/2005 |
| JP | 2005-343665 | A | 12/2005 |
| JP | 2014-073599 | A | 4/2014 |

* cited by examiner

*Primary Examiner* — Jason C Uhlenhake

(74) *Attorney, Agent, or Firm* — Workman Nydegger

(57) ABSTRACT

A medium transportation device 2 includes a transportation unit 7 that transports a medium P in a transportation direction A, an edge guide 10 that guides positions of edges $P_{end}$ of the medium P in a width direction perpendicular to the transportation direction A, and a foreign matter collecting section 13 that collects foreign matters at the edges $P_{end}$ of the medium P. With this configuration, the medium transportation device 2 can reduce a decrease in transport accuracy of media due to a foreign matter at the edge $P_{end}$ of the medium in a simple manner.

9 Claims, 4 Drawing Sheets

MEDIUM TRANSPORTATION DEVICE AND RECORDING APPARATUS

BACKGROUND

1. Technical Field

The present invention relates to medium transportation devices and recording apparatuses.

2. Related Art

A variety of medium transportation devices has been used. In these medium transportation devices, transport accuracy of media may decrease due to a foreign matter on a medium such as paper dust. Therefore, technologies are disclosed in attempt to reduce a decrease in transport accuracy of media due to a foreign matter on a medium. For example, JP-A-2014-73599 discloses a liquid ejecting apparatus (recording apparatus) which is a medium transportation device that includes a first removal section and a second removal section configured to remove a foreign matter on a medium (attached matter adhered to a paper sheet).

Using the liquid ejecting apparatus disclosed in JP-A-2014-73599 enables effective removal of a foreign matter on media. Meanwhile, in recent years, there is a demand for medium transportation devices having a long product life. In order to elongate the product life, a unit for removing a foreign matter on a medium is required to be replaced or cleaned in a simple manner. However, in the conventional medium transportation device such as the liquid ejecting apparatus disclosed in JP-A-2014-73599, replacement or cleaning of the unit for removing a foreign matter on a medium is laborious. Further, a foreign matter on a medium such as paper dust or fluff specifically tends to be present on the edge of a medium, which is a cutting portion. Accordingly, a foreign matter at the edge of a medium often causes a decrease in transport accuracy of media.

SUMMARY

An advantage of some aspects of the invention is prevention of decrease in transport accuracy of media due to a foreign matter at the edge of a medium in a simple manner.

A medium transportation device of a first aspect of the invention includes: a transportation unit that transports a medium in a transportation direction; an edge guide that guides a position of an edge of the medium; and a foreign matter collecting section that is disposed on the edge guide and is configured to collect a foreign matter at an edge of the medium.

According to this aspect, the foreign matter collecting section that collects a foreign matter is provided in the edge guide. The edge guide is configured to be moved by a user depending on the width of the medium and is disposed at an easily accessed position, and is disposed at a position corresponding to the edge of the medium. Accordingly, providing the foreign matter collecting section in the edge guide enables the foreign matter collecting section to be accurately aligned to the edge of the medium and the foreign matter collecting section disposed at an easily accessed position to be cleaned and replaced in a simple manner. Therefore, a decrease in transport accuracy of media due to a foreign matter at the edge of a medium can be reduced in a simple manner.

It is preferable that the foreign matter collecting section is detachably attached to the edge guide.

In this case, the foreign matter collecting section is detachably attached to the edge guide. As a result, cleaning and replacement of the foreign matter collecting section can be specifically easily performed. Therefore, a decrease in transport accuracy of media due to a foreign matter at the edge of a medium can be reduced in a simple manner.

It is preferable that a connecting section between the foreign matter collecting section and the edge guide includes a projection that is disposed on one of the foreign matter collecting section and the edge guide and protrudes outward therefrom, a pushing section that is disposed on the one of the foreign matter collecting section and the edge guide and configured to press the projection inward, and a recess disposed on the other of the foreign matter collecting section and the edge guide and is configured to fit on the projection.

In this case, the connecting section between the foreign matter collecting section and the edge guide includes a projection and a pushing section disposed on one of the foreign matter collecting section and the edge guide, and a recess disposed on the other of the foreign matter collecting section and the edge guide. With this configuration, the foreign matter collecting section can be easily attached to and detached from the edge guide by pressing the pushing section by one hand to engage and disengage the projection and the recess.

It is preferable that the foreign matter collecting section includes a cover section that is rotatable in a rotation direction taking the attachment and detachment direction to and from the edge guide as a rotation axis direction.

In this case, the foreign matter collecting section includes a cover section that is rotatable taking an attachment and detachment direction to and from the edge guide as a rotation axis direction. Since the attachment and detachment direction of the foreign matter collecting section to and from the edge guide is the same as the rotation axis direction of the cover section as described above, the cover section is prevented from being erroneously opened due to the cover section being unintentionally grabbed during attachment and detachment of the foreign matter collecting section to and from the edge guide so that the foreign matter collected in the foreign matter collecting section is not spilled out.

It is preferable that the medium transportation device includes a lock mechanism that locks rotation of the cover section, wherein the lock mechanism is configured to be in a locked state when the foreign matter collecting section is connected to the edge guide, and in an unlocked state when the foreign matter collecting section is unlocked from the edge guide.

In this case, the lock mechanism is configured to be in a locked state when the foreign matter collecting section is connected to the edge guide, and in an unlocked state when the foreign matter collecting section is unlocked from the edge guide. Therefore, the cover section is prevented from being unintentionally opened in the state where the foreign matter collecting section is connected to the edge guide to thereby prevent the foreign matter collected in the foreign matter collecting section from being spilled out.

It is preferable that the medium transportation device includes a plurality of transportation rollers disposed along the transportation direction as the transportation unit, wherein the edge guide is disposed upstream in the transportation direction relative to any of the plurality of transportation rollers.

In this case, a plurality of transportation rollers disposed along the transportation direction as the transportation unit, and the edge guide is disposed upstream in the transportation direction relative to any of the plurality of transportation rollers. Accordingly, the respective transportation rollers come into contact with the medium after a foreign matter is removed from the medium. As a result, attachment of a foreign matter to any of the transportation rollers can be prevented. Therefore, a decrease in transport accuracy of media due to a foreign matter at the edge of a medium can be reduced in a particularly simple manner.

A recording apparatus according to a second aspect of the invention includes the medium transportation device of the above aspect, and a recording section that performs recording on the medium transported by the medium transportation device.

According to this aspect, recording can be performed while reducing a decrease in transport accuracy of media due to a foreign matter at the edge of a medium in a simple manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
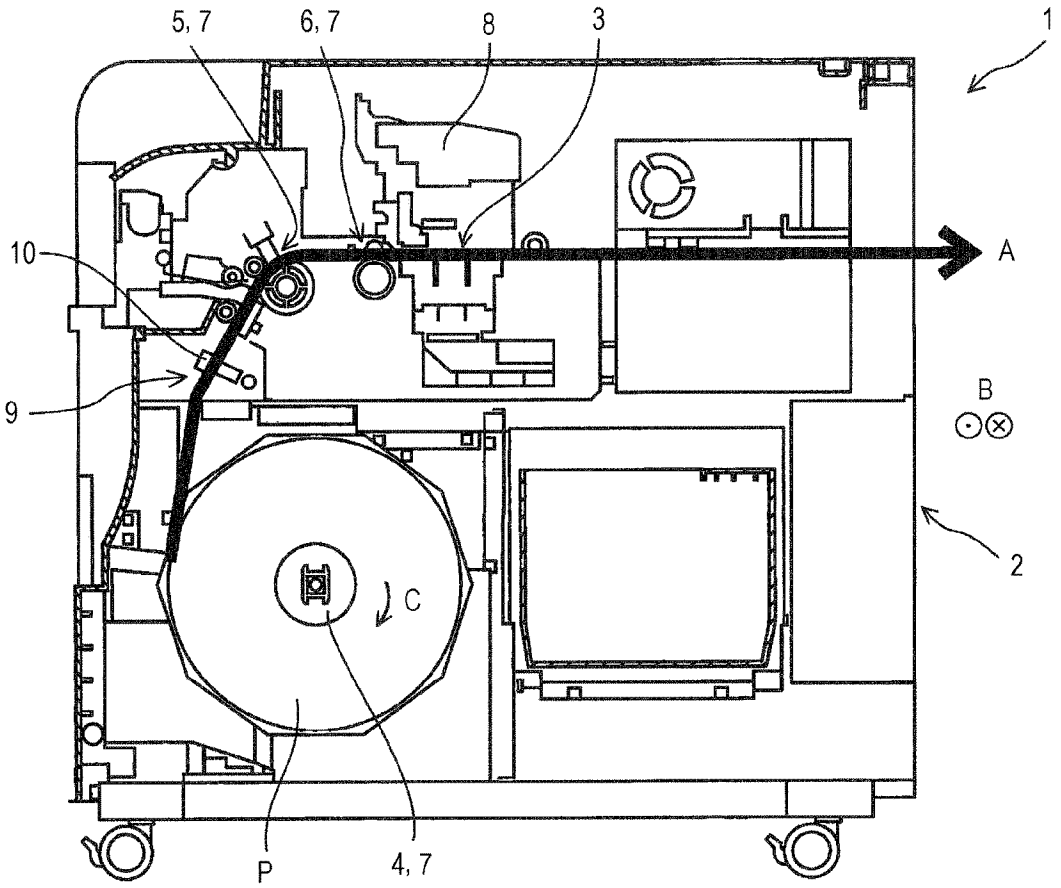
FIG. 1 is a schematic side cross-sectional view of a recording apparatus according to an embodiment of the invention.

With reference to the drawings, a recording apparatus 1 that includes a medium transportation device 2 according to Embodiment 1 of the invention will be described in detail. First, an outline of the recording apparatus 1 of the present embodiment will be described. FIG. 1 is a schematic side cross-sectional view of the recording apparatus 1 of the present embodiment.

The recording apparatus 1 of the present embodiment includes the medium transportation device 2 that is configured to transport a medium P in a transportation direction A by placing the roll-shaped medium P on a rotation shaft 4 rotatable in a rotation direction C. Further, the recording apparatus 1 also includes an edge guide 10 that guides transportation of the medium P, a plurality of transportation rollers such as transportation rollers 5 and 6 which constitute a transportation unit 7 that transports the medium P in a transportation direction A together with the rotation shaft 4, and a recording head 3 which is a recording section that performs recording on the transported medium P, which are disposed in a transportation path of the medium P.

The recording head 3 is disposed on a carriage 8 and configured to perform recording on the transported medium P by ejecting ink from nozzles, which are not shown in the figure, while reciprocating in a scan direction B which is perpendicular to the transportation direction A of the medium P. The recording apparatus 1 of the present embodiment, having the transportation unit 7 and the recording head 3 of the above configuration, can form a desired image on the medium P by repeating transportation of the medium P in the transportation direction A by a predetermined amount (1 pass) and ejection of ink while moving the recording head 3 in the scan direction B onto the medium P in a stationary state. Although the recording apparatus 1 of the present embodiment is a so-called serial printer that performs recording by repeating transportation of the medium P and scanning of the recording head 3, it may be a so-called line printer that performs continuous recording by continuously transporting the medium P using a line head having nozzles arrayed in a width direction of the medium P. Further, recording apparatuses other than ink jet printers such as transfer type printers may also be used.

The recording apparatus 1 of the present embodiment can use the roll-shaped medium P of a variety of widths. A user can guides the positions of the edges $P_{end}$ of the medium P (see FIG. 3) in the width direction perpendicular to the transportation direction A by moving the edge guide 10 disposed in an edge guide forming section 9 in the direction along the scan direction B.

Figure 2:
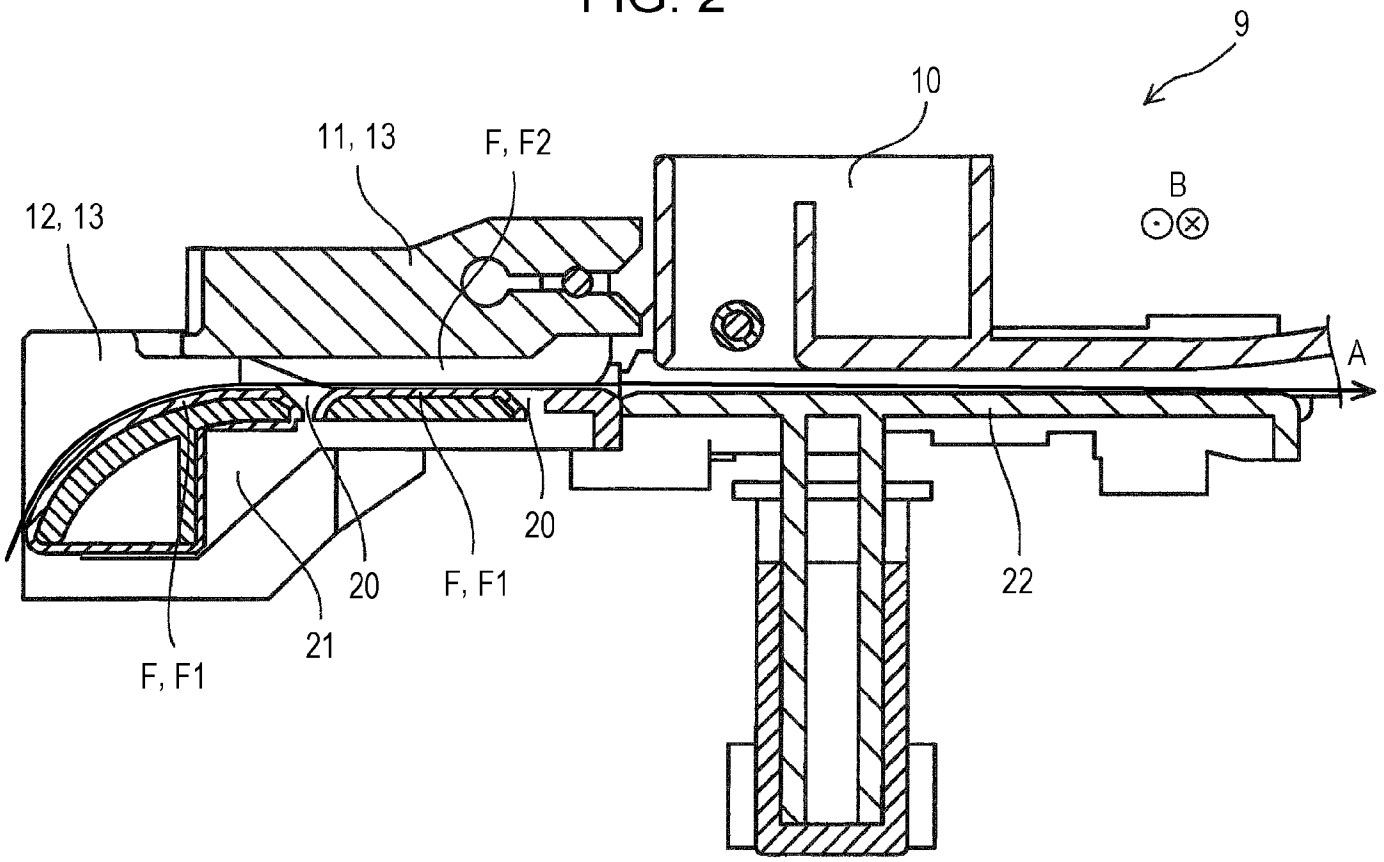
FIG. 2 is a schematic side cross-sectional view of an essential part of a recording apparatus according to an embodiment of the invention.

Next, the edge guide forming section 9 which is an essential part of the recording apparatus 1 (medium transportation device 2) of the present embodiment will be described. FIG. 2 is a schematic side cross-sectional view of the edge guide forming section 9 which is an essential part of the recording apparatus 1 of the present embodiment, and FIG. 3 is a schematic perspective view of the edge guide forming section 9 which is an essential part of the recording apparatus 1 of the present embodiment.

Figure 3:
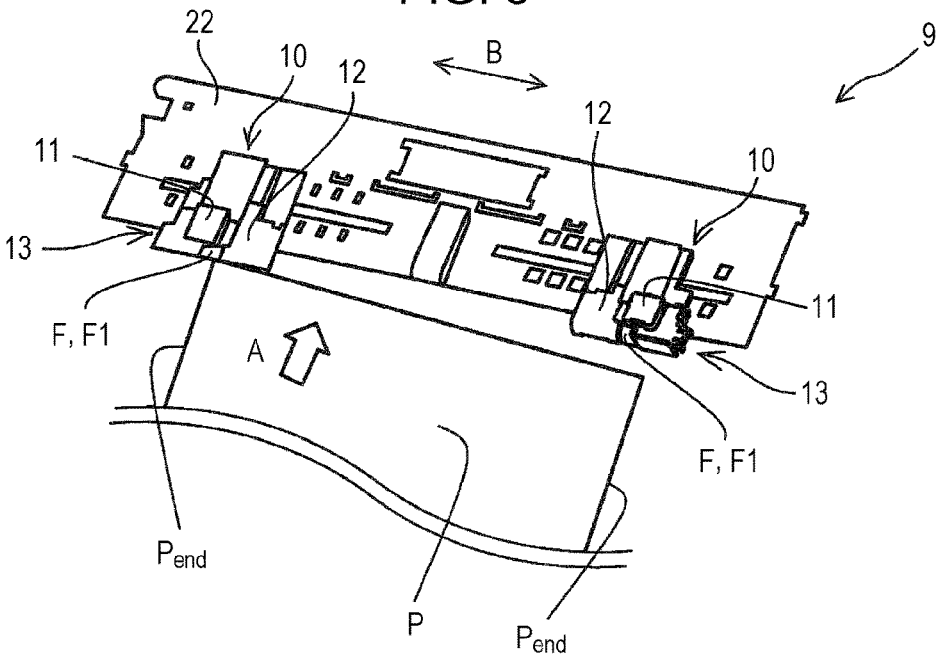
FIG. 3 is a schematic perspective view of an essential part of a recording apparatus according to an embodiment of the invention.

As shown in FIGS. 2 and 3, in the present embodiment, two edge guides 10 are provided corresponding to the both edges $P_{end}$ of the medium P so as to be movable in the scan direction B relative to a support section 22 of the medium P in the transportation path of the medium P. These edge guides 10, including a foreign matter collecting section 13, which will be described later, are formed in a bilaterally symmetrical shape with respect to the transportation direction A.

The foreign matter collecting section 13 is detachably attached to the edge guide 10. Further, FIGS. 2 and 3 illustrates that the foreign matter collecting section 13 is attached to the edge guide 10. The foreign matter collecting section 13 is composed of a foreign matter container 12 that stores a foreign matter collected from the edge $P_{end}$ of the medium P via a hole 20 into a collection chamber 21, and a cover section 11 that is disposed on the foreign matter container 12. Further, a felt F (felts F1 and F2) that collects a foreign matter is disposed on each portion of the foreign matter container 12 and the cover section 11 which is in contact with the edge $P_{end}$ of the medium P (see FIG. 6). When the medium P is transported with the edge $P_{end}$ of the medium P being pinched by the felt F1 attached to the foreign matter container 12 and the felt F2 attached to the cover section 11, a foreign matter at the edge $P_{end}$ of the medium P is collected. As a foreign matter is sequentially collected, the foreign matter previously collected by being pinched by the felt F1 of the foreign matter container 12 and the felt F2 of the cover section 11 is pushed by a newly collected foreign matter and dropped into the hole 20 to be collected in the collection chamber 21.

That is, the medium transportation device 2 of the present embodiment includes the transportation unit 7 that transports the medium P in the transportation direction A, the edge guide 10 that regulates positions of the edges $P_{end}$ of the medium P in the width direction perpendicular to the transportation direction A to thereby guide transportation of the medium P, and the foreign matter collecting section 13 that collects foreign matters at the edges $P_{end}$ of the medium P. Since the medium transportation device 2 of the present embodiment has the foreign matter collecting section 13 in the edge guide 10, the foreign matter collecting section 13 can be accurately aligned to the edge $P_{end}$ of the medium P. In addition, the foreign matter collecting section 13, which is disposed at the forming position of the edge guide 10 which is easily accessed by a user, can be cleaned and replaced in a simple manner. Therefore, the medium transportation device 2 of the present embodiment can reduce a decrease in transport accuracy of media P due to a foreign matter at the edge $P_{end}$ of the medium P in a simple manner.

In other words, the recording apparatus 1 of the present embodiment includes the medium transportation device 2 having the above configuration, and the recording head 3 that performs recording on the medium P transported by the medium transportation device 2. Accordingly, recording can be performed on the medium P while reducing a decrease in transport accuracy of media due to a foreign matter at the edge $P_{end}$ of the medium P in a simple manner.

Although details of the configuration will be described later, the foreign matter collecting section 13 of the present embodiment is detachable attached to the edge guide 10. Accordingly, cleaning and replacement of the foreign matter collecting section 13 can be particularly easily performed. Specifically, cleaning and replacement of the felt F1 attached to the foreign matter container 12, cleaning and replacement of the felt F2 attached to the cover section 11, and disposal of the foreign matter collected in the collection chamber 21 can be easily performed by the user. Accordingly, the medium transportation device 2 of the present embodiment is configured such that a decrease in transport accuracy of media due to a foreign matter at the edge $P_{end}$ of the medium can be reduced in a simple manner.

As shown in FIG. 1, while the medium transportation device 2 of the present embodiment includes a plurality of transportation rollers such as the transportation rollers 5 and 6 disposed in the transportation direction A as the transportation unit 7, the edge guide forming section 9 (edge guide 10) is disposed upstream in the transportation direction A relative to any of the plurality of transportation rollers such as the transportation rollers 5 and 6. Accordingly, the respective transportation rollers come into contact with the medium P after a foreign matter is removed from the medium P. As a result, attachment of a foreign matter to any of the transportation rollers such as the transportation rollers 5 and 6 can be prevented. Therefore, the medium transportation device 2 of the present embodiment is configured such that a decrease in transport accuracy of media due to a foreign matter at the edge $P_{end}$ of the medium can be effectively reduced.

Figure 4:
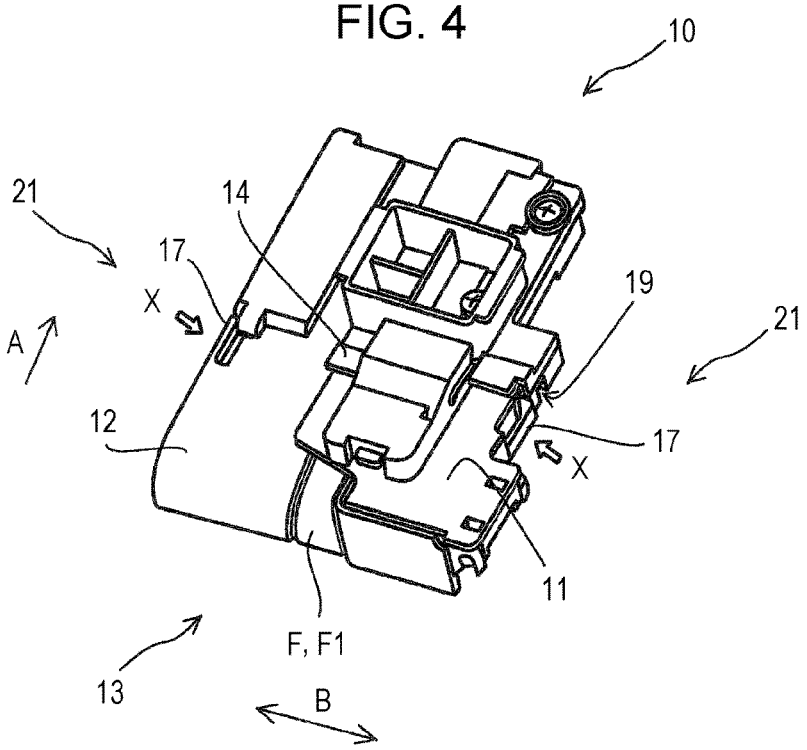
FIG. 4 is a schematic perspective view of an essential part of a recording apparatus according to an embodiment of the invention.
Figure 5:
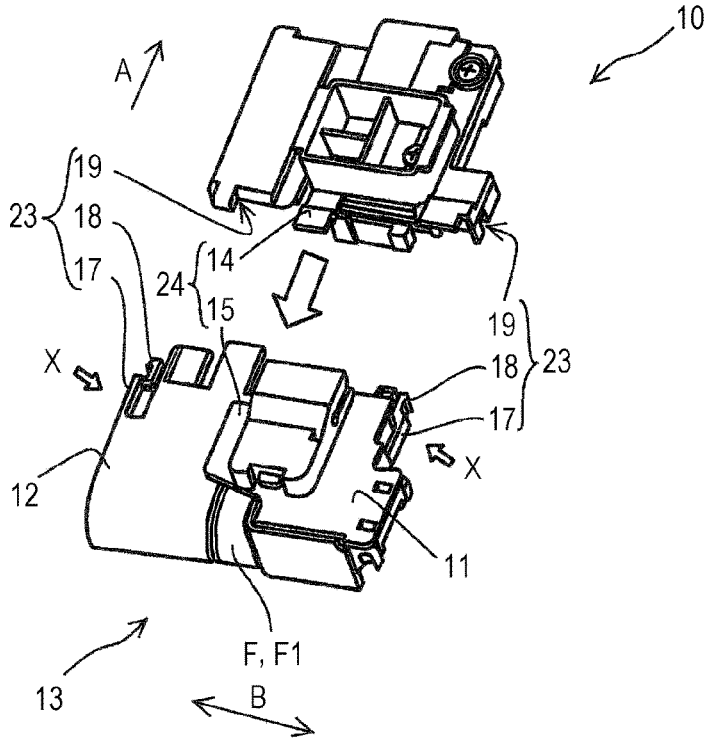
FIG. 5 is a schematic perspective view of an essential part of a recording apparatus according to an embodiment of the invention.
Figure 6:
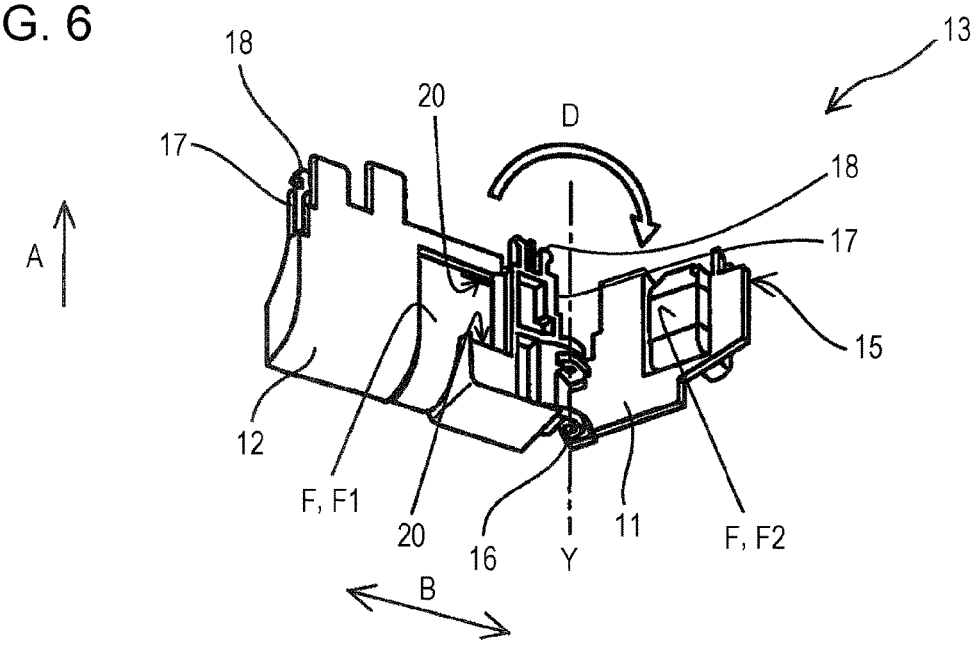
FIG. 6 is a schematic perspective view of an essential part of a recording apparatus according to an embodiment of the invention.

Next, the foreign matter collecting section 13 which is an essential part of the recording apparatus 1 (medium transportation device 2) of the present embodiment will be described in detail. FIGS. 4 to 6 are schematic perspective views of the foreign matter collecting section 13 which is an essential part of the recording apparatus 1 (medium transportation device 2) of the present embodiment. Of these figures, FIG. 4 illustrates that the foreign matter collecting section 13 is attached to the edge guide 10, FIG. 5 illustrates that the foreign matter collecting section 13 is removed from the edge guide 10, and FIG. 6 illustrates that the cover section 11 is open from the foreign matter container 12 in the foreign matter collecting section 13 which has been removed from the edge guide 10.

As shown in FIGS. 4 and 5, the foreign matter collecting section 13 of the present embodiment is detachably attached to the edge guide 10 along the transportation direction A. Specifically, a connecting section 23 between the foreign matter collecting section 13 and the edge guide 10 in the medium transportation device 2 of the present embodiment includes a projection 18 that is disposed on the foreign matter collecting section 13, which is one of the foreign matter collecting section 13 and the edge guide 10, and protrudes outward therefrom, a pushing section 17 that is disposed on the foreign matter collecting section 13, which is the one of the foreign matter collecting section 13 and the edge guide 10, and configured to press the projection 18 inward (in the X direction), and a recess 19 disposed on the edge guide 10, which is the other of the foreign matter collecting section 13 and the edge guide 10, and is configured to fit on the projection 18. With this configuration, the foreign matter collecting section 13 can be easily attached to and detached from the edge guide 10 by one hand by pressing the pushing section 17 in the X direction to engage and disengage the projection 18 and the recess 19. Further, although the connecting section 23 of the present embodiment is configured such that the projection 18 and the pushing section 17 are disposed on the foreign matter collecting section 13 and the recess 19 is disposed on the edge guide 10 as described above, the configuration in which the recess 19 is disposed on the foreign matter collecting section 13 and the projection 18 and the pushing section 17 are disposed on the edge guide 10 may also be possible. However, the configuration of the connecting section 23 of the present embodiment is particularly preferred since the foreign matter collecting section 13 can be more easily attached to and detached from the edge guide 10.

As shown in FIG. 6, the foreign matter collecting section 13 of the medium transportation device 2 of the present embodiment includes the cover section 11 that is rotatable in a rotation direction D taking the attachment and detachment direction to and from the edge guide 10 (direction along the transportation direction A) as a rotation axis direction Y of the rotation shaft 16. Since the attachment and detachment direction of the foreign matter collecting section 13 to and from the edge guide 10 is different from the rotation direction of the cover section 11 as described above, the cover section 11 is prevented from being erroneously opened due to the cover section 11 being unintentionally grabbed during attachment and detachment of the foreign matter collecting section 13 to and from the edge guide 10 so that the foreign matter collected in the foreign matter collecting section 13 (foreign matter collected in the collection chamber 21) is not spilled out.

Further, as shown in FIGS. 4 and 5, the edge guide 10 is provided with a press section 14 that can press a top surface 15 of the cover section 11 while the foreign matter collecting section 13 is attached to the edge guide 10. That is, the press section 14 and the top surface 15 are composed of a lock mechanism 24 that locks rotation of the cover section 11. In other words, the medium transportation device 2 of the present embodiment includes the lock mechanism 24 that locks rotation of the cover section 11, and the lock mechanism 24 is configured to be in a locked state (the state where the top surface 15 is pressed by the press section 14) when the foreign matter collecting section 13 is connected to the edge guide 10, and in an unlocked state (the state where the top surface 15 is not pressed by the press section 14) when the foreign matter collecting section 13 is unlocked from the edge guide 10. Accordingly, the cover section 11 is prevented from being unintentionally opened in the state where the foreign matter collecting section 13 is connected to the edge guide 10 to thereby prevent the foreign matter collected in the foreign matter collecting section 13 from being spilled out. In addition to that, the edge $P_{end}$ of the medium P is reliably pinched by the felt F1 of the foreign matter container 12 and the felt F2 of the cover section 11 during collection of foreign matter so as to ensure collection of a foreign matter. The configuration of the lock mechanism 24 is not specifically limited, and may be a configuration different from that of the present embodiment.

It should be noted that the invention is not limited to the above embodiments. Regardless to say, various modifications are contemplated within the scope of the invention as defined in the appended claims, and these should be included in the scope of the invention.

This application claims priority under 35 U.S.C. § 119 to Japanese Patent Application No. 2016-171054, filed Sep. 1, 2016. The entire disclosure of Japanese Patent Application No. 2016-171054 is hereby incorporated herein by reference.

What is claimed is:

1. A medium transportation device comprising:

a transportation unit that transports a medium in a transportation direction;

an edge guide that guides a position of an edge of the medium; and a foreign matter collecting section that is disposed on the edge guide and is configured to collect a foreign matter at an edge of the medium, wherein the foreign matter collecting section is detachably attached to the edge guide, and wherein the foreign matter collecting section includes a cover section that is rotatable taking an attachment and detachment direction to and from the edge guide as a rotation axis direction.

2. The medium transportation device according to claim 1, wherein a connecting section between the foreign matter collecting section and the edge guide includes a projection that is disposed on one of the foreign matter collecting section and the edge guide and protrudes outward therefrom, a pushing section that is disposed on the one of the foreign matter collecting section and the edge guide and configured to press the projection inward, and a recess disposed on the other of the foreign matter collecting section and the edge guide and is configured to fit on the projection.

3. A recording apparatus comprising:

the medium transportation device according to claim 2; and a recording section that performs recording on the medium transported by the medium transportation device.

4. The medium transportation device according to claim 1 further comprising a lock mechanism that locks rotation of the cover section, wherein the lock mechanism is configured to be in a locked state when the foreign matter collecting section is connected to the edge guide, and in an unlocked state when the foreign matter collecting section is unlocked from the edge guide.

5. A recording apparatus comprising:

the medium transportation device according to claim 4; and a recording section that performs recording on the medium transported by the medium transportation device.

6. The medium transportation device according to claim 1 further comprising a plurality of transportation rollers disposed along the transportation direction as the transportation unit, wherein the edge guide is disposed upstream in the transportation direction relative to any of the plurality of transportation rollers.

7. A recording apparatus comprising:

the medium transportation device according to claim 6; and a recording section that performs recording on the medium transported by the medium transportation device.

8. A recording apparatus comprising:

the medium transportation device according to claim 1; and a recording section that performs recording on the medium transported by the medium transportation device.

9. A medium transportation device comprising:

a transportation unit that transports a medium in a transportation direction;

an edge guide that guides a position of an edge of the medium; and a foreign matter collecting section that is disposed on the edge guide and is configured to collect a foreign matter at an edge of the medium, wherein the foreign matter collecting section is detachably attached to the edge guide, and wherein a connecting section between the foreign matter collecting section and the edge guide includes a projection that is disposed on one of the foreign matter collecting section and the edge guide and protrudes outward therefrom, a pushing section that is disposed on the one of the foreign matter collecting section and the edge guide and configured to press the projection inward, and a recess disposed on the other of the foreign matter collecting section and the edge guide and is configured to fit on the projection.

* * * * *